US010046890B2

(12) United States Patent
Philip et al.

(10) Patent No.: US 10,046,890 B2
(45) Date of Patent: Aug. 14, 2018

(54) CHILD RESISTANT TIP CLOSURE ASSEMBLY WITH FINGER SPRING

(71) Applicant: Amcor Group GmbH, Zurich (CH)

(72) Inventors: Bradley S. Philip, Tecumseh, MI (US); David Downing, Manchester, MI (US); Todd Mastic, Saline, MI (US); Don F. Yeager, Millville, NJ (US); James Mierzwiak, Manchester, MI (US)

(73) Assignee: Amcor Group GmbH, Zurich (CH)

( * ) Notice: Subject to any disclaimer, the term of this patent is extended or adjusted under 35 U.S.C. 154(b) by 436 days.

(21) Appl. No.: 14/442,695

(22) PCT Filed: Nov. 14, 2013

(86) PCT No.: PCT/US2013/070041

§ 371 (c)(1),
(2) Date: May 13, 2015

(87) PCT Pub. No.: WO2014/078501

PCT Pub. Date: May 22, 2014

(65) Prior Publication Data

US 2016/0280428 A1 Sep. 29, 2016

Related U.S. Application Data

(60) Provisional application No. 61/726,799, filed on Nov. 15, 2012.

(51) Int. Cl.
*B65D 50/04* (2006.01)

(52) U.S. Cl.
CPC ..... *B65D 50/041* (2013.01)

(58) Field of Classification Search
CPC ..... B65D 50/041; B65D 51/228; B65D 2251/0015; B65D 2251/0093; B65D 2251/0059

(Continued)

(56) References Cited

U.S. PATENT DOCUMENTS 3,055,524 A 9/1962 Glasbrenner
3,472,411 A 10/1969 Turner (Continued)

FOREIGN PATENT DOCUMENTS

EP 1857373 A1 11/2007
EP 1975079 A1 10/2008

(Continued)

OTHER PUBLICATIONS

Office Action dated Jun. 27, 2017 in corresponding Japanese Application No. 2015-542768 (4 pages).

(Continued)

*Primary Examiner* — Chun Cheung
*Assistant Examiner* — Brijesh V. Patel
(74) *Attorney, Agent, or Firm* — Harness, Dickey & Pierce, P.L.C.

(57) ABSTRACT

A child resistant closure for use on a container that include an inner closure member having a threaded portion and an inclined surface, and an outer closure member coupled to the inner closure member for axial translation therebetween. A series of engagement features extend between the inner and outer closure to permit selective engagement of the outer closure to the inner closure to effect removal of the child resistant closure. The outer closure includes at least one finger spring member being inwardly directed and contacting the inclined surface of the inner closure member, thereby biasing the outer closure member into an operationally disengaged position. The finger spring member T-shaped in cross-section.

15 Claims, 7 Drawing Sheets

(58) Field of Classification Search
USPC ..... 220/258.4, 277–278, 288, 378, 675; 215/204, 217, 219–221, 252, 258, 330; 206/222; D9/434, 454
See application file for complete search history.

(56) References Cited

U.S. PATENT DOCUMENTS

| | | | | |
|---|---|---|---|---|
| 3,622,027 | A | 11/1971 | Maki | |
| 3,638,819 | A | 2/1972 | Roy | |
| 3,682,343 | A | 8/1972 | Landen | |
| 3,698,585 | A | 10/1972 | Smith et al. | |
| 3,722,727 | A | 3/1973 | Gach | |
| 3,776,407 | A | 12/1973 | Cistone | |
| 3,809,272 | A | 5/1974 | Maki | |
| 3,830,390 | A | 8/1974 | Gach | |
| 3,853,236 | A | 12/1974 | Ostrowsky | |
| 3,863,796 | A | 2/1975 | Roy | |
| 3,878,961 | A | 4/1975 | Curry et al. | |
| 3,912,101 | A | 10/1975 | Rayner et al. | |
| 4,004,704 | A | 1/1977 | Hilaire | |
| 4,095,717 | A | 6/1978 | Michaelsen | |
| 4,385,705 | A | 5/1983 | Kusz | |
| 4,474,301 | A | 10/1984 | Davis | |
| 4,520,938 | A | 6/1985 | Finke | |
| 4,555,036 | A | 11/1985 | Bekkers et al. | |
| 4,705,181 | A * | 11/1987 | Burke ..... | B65D 50/041 215/213 |
| 4,834,251 | A | 5/1989 | Yu | |
| 4,854,459 | A | 8/1989 | DeJonge | |
| 5,115,928 | A | 5/1992 | Drummond, Jr. | |
| 5,611,443 | A | 3/1997 | King | |
| 5,743,419 | A | 4/1998 | King | |
| 5,918,752 | A | 7/1999 | Meyer | |
| 6,875,201 | B1 | 4/2005 | Kawashima et al. | |
| 8,157,115 | B2 | 4/2012 | Rho | |
| 8,286,811 | B1 | 10/2012 | Adamczak | |
| 2002/0027120 | A1 * | 3/2002 | Miceli ..... | B65D 41/0492 215/228 |
| 2003/0034322 | A1 * | 2/2003 | Doherty ..... | B65D 41/0478 215/228 |
| 2005/0161425 | A1 | 7/2005 | Morini | |
| 2008/0164234 | A1 | 7/2008 | Rho | |
| 2008/0314000 | A1 * | 12/2008 | Druitt ..... | B65D 41/04 53/490 |
| 2009/0242561 | A1 | 10/2009 | Wellman | |
| 2009/0250465 | A1 | 10/2009 | Martinez et al. | |
| 2013/0015157 | A1 | 1/2013 | Rho | |
| 2014/0014611 | A1 | 1/2014 | Buehler et al. | |

FOREIGN PATENT DOCUMENTS

| | | | |
|---|---|---|---|
| GB | 2182648 | A | 5/1987 |
| JP | 52-018632 | | 5/1977 |
| JP | 11-501595 | | 2/1999 |
| JP | 2000-226047 | A | 8/2000 |
| JP | 2008-030823 | A | 2/2008 |
| JP | 2010-076840 | A | 4/2010 |
| KR | 20060099794 | A | 9/2006 |

OTHER PUBLICATIONS

International Search Report and Written Opinion for PCT/US2013/070032, dated Feb. 18, 2014; ISA/KR.
International Search Report and Written Opinion for PCT/US2013/070041, dated Feb. 27, 2014; ISA/KR.
Communication dated May 29, 2017 in corresponding European Application No. 138552419 (5 pages).

* cited by examiner

CHILD RESISTANT TIP CLOSURE ASSEMBLY WITH FINGER SPRING

CROSS-REFERENCE TO RELATED APPLICATIONS

This application claims the benefit of U.S. Provisional Application No. 61/726,799, filed on Nov. 15, 2012. The entire disclosure of the above application is incorporated herein by reference.

FIELD

The present disclosure relates to child resistant closures and, more particularly, relates to child resistant tip closure assemblies having finger spring systems.

BACKGROUND

This section provides background information related to the present disclosure which is not necessarily prior art.

Child resistant closures have been used in a wide variety of applications for many years. Traditionally, these child resistant closures, often referred to as CRCs, are used to provide a disengagement feature in the lid of a container or package to prevent access of the contents of the container by a child. To this end, the lid of the container often includes a mechanical engagement system that is normally disengaged to permit the free rotation of an outer member of the lid relative to an inner member of the lid. The outer member of the lid is configured to be grasped by a user and the inner member of the lid is configured to, typically, threadedly engage the opening or finish of the container. The outer member of the lid can, in some traditional designs, include a feature that must be manipulated by an adult user to engage outer and inner closure. This adult-manipulated feature may include various prong devices, spring compression, lifting mechanism or similar device.

Unfortunately, current CRC designs tend to employ adult-manipulated features that are particularly well suited for large containers, such as medicine bottles, cleaning detergent bottles, and the like. However, more recently, there has been a regulatory move to requiring the use of CRCs on containers that are substantially smaller than current containers employing CRCs.

In particular, the Consumer Product Safety Commission (CPSC) has notified the ophthalmic industry of the Commission's plans to require certain product packages that contain at least 0.08 mg of Imidazolines, such as ophthalmic products, will be required to employ child resistant closures on its containers and packaging. Unfortunately, traditional child resistant closures have not been employed in smaller containers, such as, but not limited to, those containers having finish openings less than or equal to about 20 mm.

Furthermore, it appears that traditional child resistant closures, which are used on larger containers, cannot be easily scaled down to work on smaller containers. That is, because many of these traditional child resistant closures employ mechanical or living hinges and/or other mechanical engagement systems, these traditional child resistant closures cannot simply be reduced in size because of the changing in operation of the hinges or engagement systems. What is needed, in order to comply with the potential for new regulations and to provide the market with a viable and reliable child resistant closure, is a child resistant closure that can properly, reliably, and safely operate on or in closures adapted for use with small containers or packages, such as, but not limited to, containers having finish openings less than or equal to about 20 mm. It should be understood that although the aforementioned goal is an object of the present teachings, it should not be regarded as limiting the scope of the present teachings or the use of the closures of the present application. It should be understood that child resistant closures used on small containers can often be up-scaled for use on larger containers; however, child resistant closures used on large containers cannot often be down-scaled for use on smaller containers. However, the teachings of the present application provide a child resistant closure that can be used on containers having finish openings less than or equal to about 20 mm. It should be understood that the present teachings can be used on finish openings greater than 20 mm. Moreover, the present teachings are particularly well-suited for use on ophthalmic or other containers having 18 mm, 15 mm, and 13 mm finishes.

SUMMARY

This section provides a general summary of the disclosure, and is not a comprehensive disclosure of its full scope or all of its features.

According to the principles of the present teachings, a child resistant closure is provided for use on a container that includes an inner closure member having a threaded portion and an inclined surface, and an outer closure member coupled to the inner closure member for axial translation therebetween. A series of engagement features extend between the inner and outer closure to permit selective engagement of the outer closure to the inner closure to effect removal of the child resistant closure. The outer closure includes at least one finger spring member being inwardly directed and contacting the inclined surface of the inner closure member, thereby biasing the outer closure member into an operationally disengaged position. The finger spring member can be T-shaped in cross-section.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
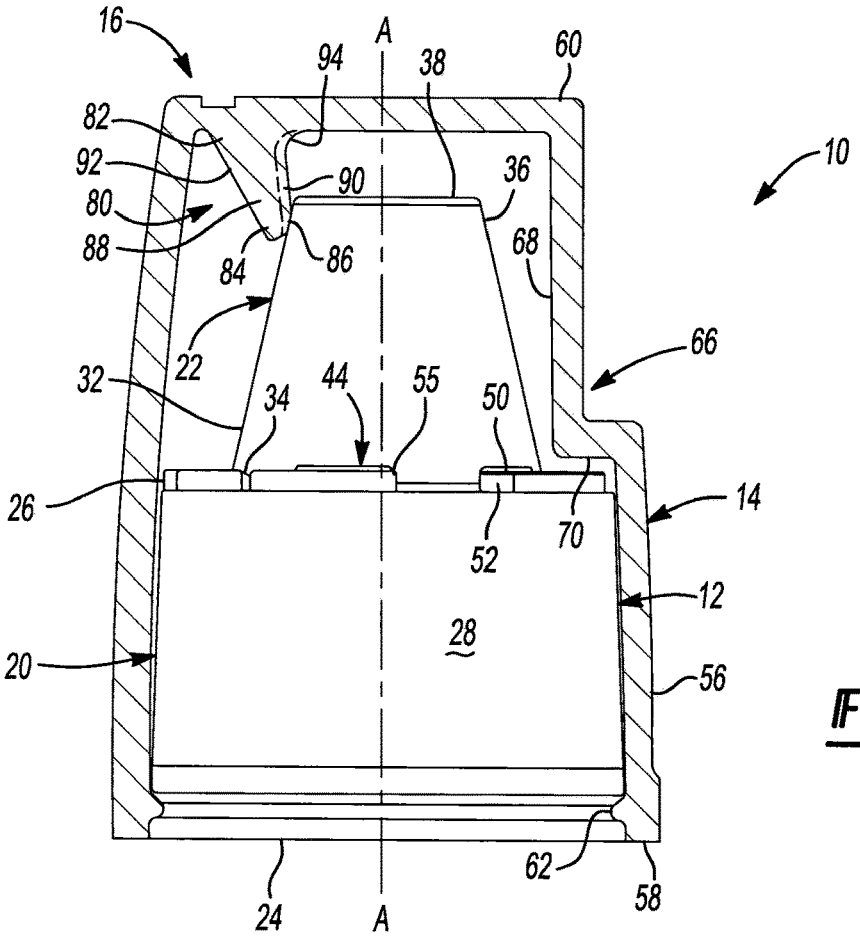
FIG. 1 is a cross-sectional view illustrating a child resistant tip closure assembly according to the principles of the present teachings.
Figure 2:
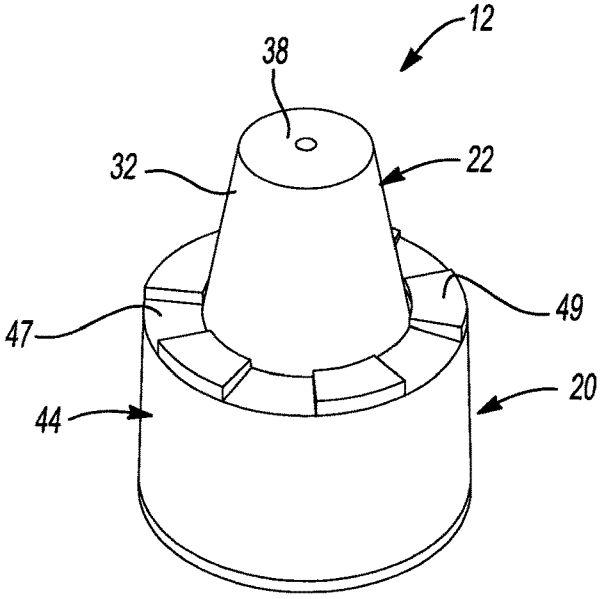
FIG. 2 is a perspective view of an inner closure member according to the principles of the present teachings.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

According to the principles of the present teachings, as described in the following description and illustrated in the attached figures, a novel child resistant closure (CRC) assembly 10 is provided that overcome the limitations of the prior art and provides a safe and reliable tip closure that is capable of being using on any number of packages or containers. In particular, the CRC assembly 10 is well-suited for containers or packages that define a small-sized finish, such as less than or equal to about 20 mm. In some embodiments, the present teachings are particular well-suited for use on containers having finishes that are less than or about 18 mm, or specifically 15 mm and 13 mm. It should be understood, however, the present teachings can be easily up-sized to be used on containers having larger finish dimensions, such as greater than 20 mm. Therefore, the teachings of the present application should not be regarded as being limited to any particular size, unless specifically and explicitly claimed in the Claims section herein.

Figure 18:
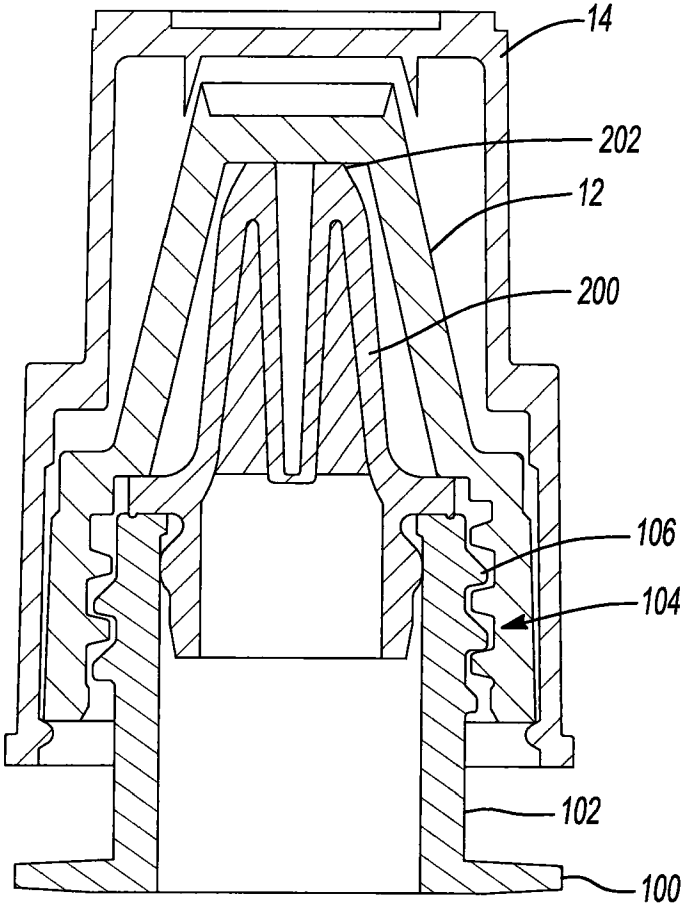
FIG. 18 is a cross-sectional view of a child resistant tip closure assembly according to some embodiments of the present teachings.
Figure 17:
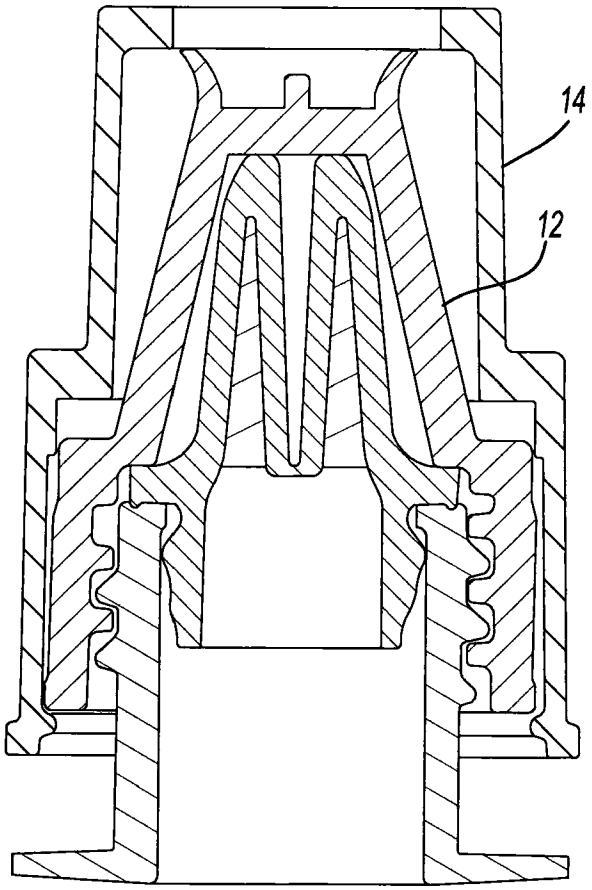
FIG. 17 is a cross-sectional view of a child resistant tip closure assembly according to some embodiments of the present teachings.
Figure 19:
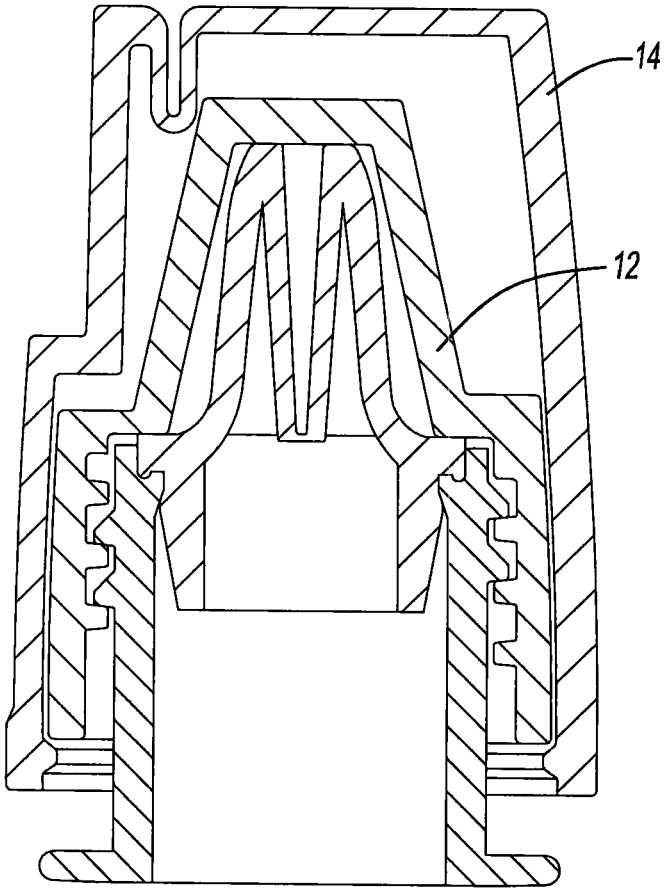
FIG. 19 is a cross-sectional view of a child resistant tip closure assembly according to some embodiments of the present teachings.

Briefly, it should be understood that the CRC assembly 10 of the present teachings is adapted to be threadedly engaged with the finish 102 of a container 100 (see FIGS. 17-19). Such containers typically define a body that includes an upper portion having a cylindrical sidewall forming a finish 102. Integrally formed with the finish and extending downward therefrom is a shoulder portion. The shoulder portion merges into and provides a transition between the finish 102 and a sidewall portion. The sidewall portion extends downward from the shoulder portion to a base portion having a base, thereby enclosing a volume for retaining a product. The finish 102 of the container 100 may include a threaded region 104 having threads 106. The threaded region 104 provides a means for attachment of a similarly threaded portion of CRC assembly 10, which will be described herein. Accordingly, CRC assembly 10 engages the finish 102 to preferably provide a hermetical seal of the container 100.

In some embodiments, as illustrated in FIGS. 17-19, container 100 can comprise a dispensing tip 200 for dispensing the contained product in an advantageous way or for dosing a predetermined amount of the product. For instance, container 100 can be used for dispensing an ophthalmic medication and, thus, may employ a dispensing tip (e.g. eye dropper). Conventional dispensing tips are often sized to be press-fit within a portion of finish 102 of container 100 and comprise an elongated tip having a distal end 202 through which product is dispensed.

Although container 100 is illustrated and described as an ophthalmic container dispensing ophthalmic product, it should be understood that container 100 can be any container having any product to which employing a child resistant closure is advantageous. Therefore, the aesthetic styling of container and CRC assembly 10 can have different shapes, materials, and the like, without departing from the principles of the present teachings.

With general reference to the FIG. 1, CRC assembly 10 of the present teachings is a child resistant tip closure that is generally regarded as being of the "push down and turn" class of child resistant closures. This class of child resistant closures employs two mechanisms that must be combined for removal of the closure; namely, a downward force to operationally engage teeth between the outer closure and inner closure and rotation to unscrew the closure from the container. The combination of two mechanisms increases the likelihood that a child cannot break into the container due to the complexity of the cognitive and major motor skills required. A spring mechanism is typically employed to separate the inner closure from the outer closure, however conventional designs have failed to provide a system that can be used on small finish containers.

With particular reference to FIG. 1, CRC assembly 10 is illustrated having an inner closure 12 and an outer closure 14 disposed upon and circumferentially surrounding and encapsulating inner closure 12. In this way, mechanical manipulation of inner closure 12 is limited to only being achieved via outer closure 14. Inner closure 12 and outer closure 14 are sized and configured to permit relative axial translation therebetween. Specifically, outer closure 14 is sized and configured to permit axial translation from an operationally disengaged position, which permits free rotational movement of outer closure 14 relative to inner closure 12, and an operationally engaged position, which selectively joins outer closure 14 and inner closure 12 for simultaneous joined rotation therebetween. It should be recognized that in the disengaged position, outer closure 14 will spin freely relative to inner closure 12 thereby preventing threaded disengagement of inner closure 12 from finish 102 of container 100. Conversely, in the engaged position, outer closure 14 is keyed or otherwise joined to inner closure 12 for rotation therewith to permit rotational force of outer closure 14 to rotate inner closure 12, thereby threadedly disengaging inner closure 12 from finish 102. Outer closure 14 is normally biased into the disengaged position by a spring system 16, as will be discussed in detail herein. During actuation, outer closure 14 is depressed a predetermined stroke distance by overcoming the biasing force of spring system 16 such that complementary features of inner closure 12 and outer closure 14 are joined to permit the aforementioned keyed or joined configuration for rotation.

With particular reference to FIGS. 1-7, inner closure 12 generally comprises a body portion 20 and a cap portion 22. In some embodiments, body portion 20 comprises a generally cylindrical body having a proximal end 24, a distal end 26, and an outer sidewall 28 extending therebetween. In some embodiments, proximal end 24 is generally flat and, as will be discussed herein, abuts or otherwise engages a portion of outer closure 14. Sidewall 28 is generally closely spaced relative to an inner sidewall of outer closure 14, thereby it is desirable, in some embodiments, that sidewall 28 of inner closure 12 is without obstructions to permit the free rotation of outer closure 14 relative to inner closure 12. In other embodiments, sidewall 28 of inner closure 12 may have obstructions to permit securing closure on to container finish. In some embodiments, inner closure 12 is injection mold and formed of a thermoplastic material.

Inner closure 12 can further comprise a threaded portion 30 (FIG. 6) extending along an interior side of sidewall 28. Threaded portion 30 is sized and configured to threadedly engage the corresponding threads 106 of threaded portion 104 of container 100 in a known manner.

In some embodiments, cap portion 22 of inner closure 12 can comprise a generally conical shape having a generally converging sidewall 32 extending from a proximal end 34, which is adjoined to distal end 26 of body portion 20 (and, in some embodiments, integrally formed therewith), to a distal end 36. Distal end 36, in some embodiments, forms a generally-flat, outer, truncated surface 38. In some embodiments, cap portion 22 can comprise a generally uniform interior surface offset from sidewall 32 and truncated surface 38. More particularly, in some embodiments, cap portion 22 can comprise a converging interior sidewall 40 terminating at an interior end surface 42. In some embodiments, interior end surface 42 is sized to physically contact or otherwise engage distal end 202 of dispensing tip 200 to provide a seal therebetween for containing product.

It should be understood that inner closure 12 can be varied in any one of a number of ways. By way of non-limiting example, it should be understood that cap portion 22 can be sized or shaped to more appropriately complement a varied dispensing tip shape. That is, if a different dispensing shape is desired, a revised interior shape of cap portion 22 that closely conforms to the dispensing tip may also be desired. To minimize material issues as a result of molding the revised cap portion, it might thus be desirable to translate any shape modifications of the interior of cap portion 22 to the outer surface thereof. Thus, the overall shape of cap portion 22, and/or inner closure 12, may vary. But, such variations should not be regarded as departing from the principles of the present teachings.

Figure 3:
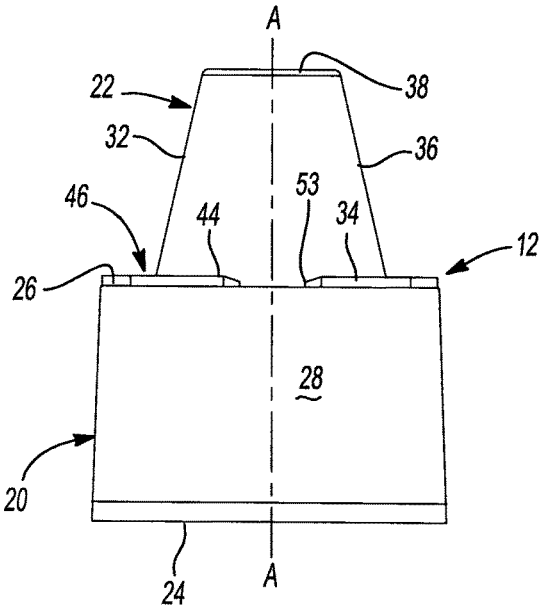
FIG. 3 is a side view of the inner closure member according to the principles of the present teachings.
Figure 4:
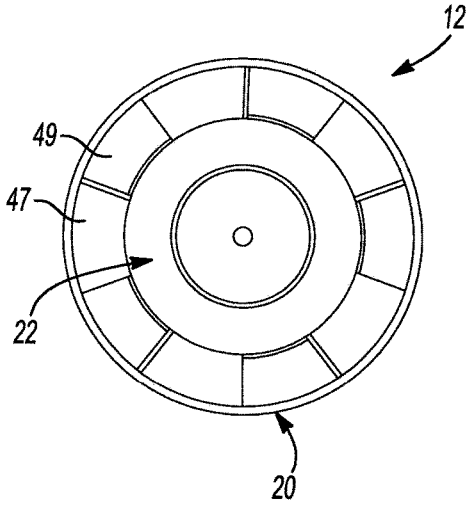
FIG. 4 is a top view of the inner closure member according to the principles of the present teachings.
Figure 5:
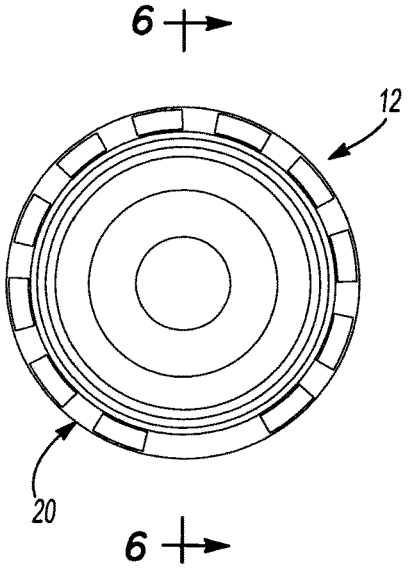
FIG. 5 is a bottom view of the inner closure member according to the principles of the present teachings.
Figure 6:
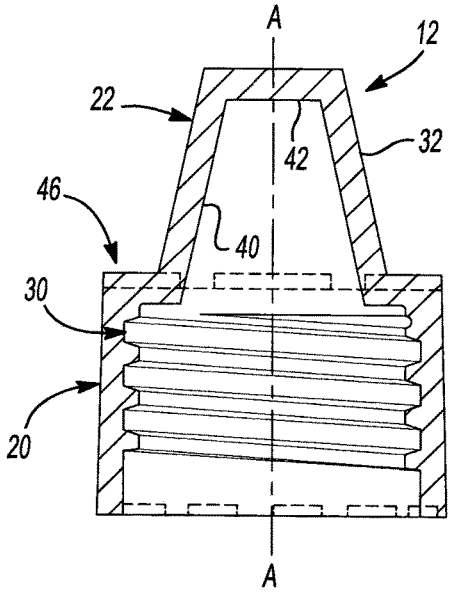
FIG. 6 is a cross-sectional view of the inner closure member taken along line 6-6 of FIG. 5 according to the principles of the present teachings.
Figure 7:
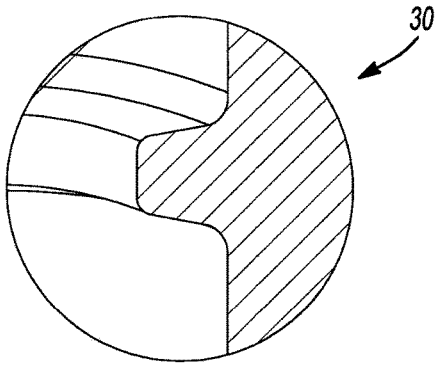
FIG. 7 is a partial cross-sectional side view of the inner closure member according to the principles of the present teachings.
Figure 8:
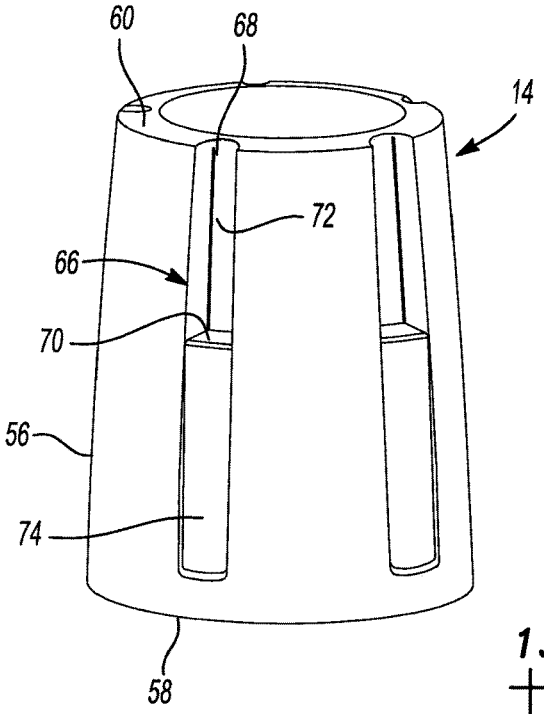
FIG. 8 is a perspective view of an outer closure member having a finger spring according to the principles of the present teachings.
Figure 9:
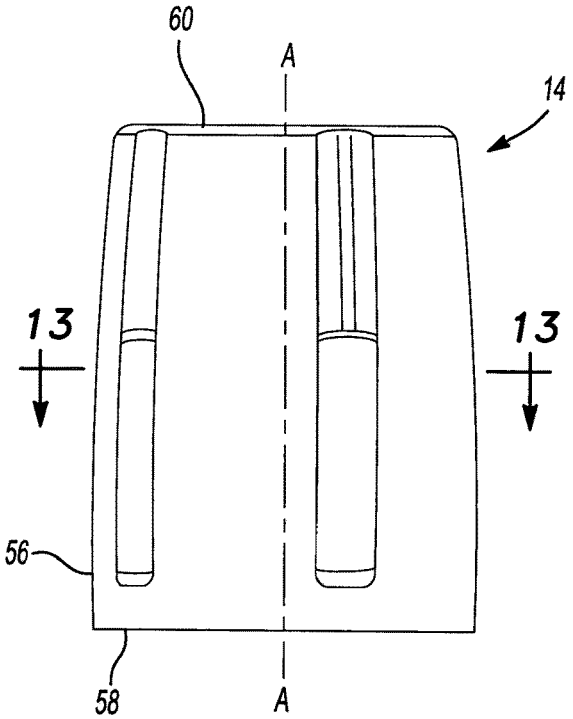
FIG. 9 is a side view of the outer closure member according to the principles of the present teachings.
Figure 10:
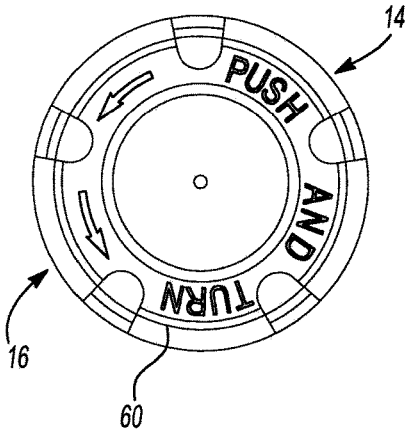
FIG. 10 is a top view of the outer closure member according to the principles of the present teachings.
Figure 11:
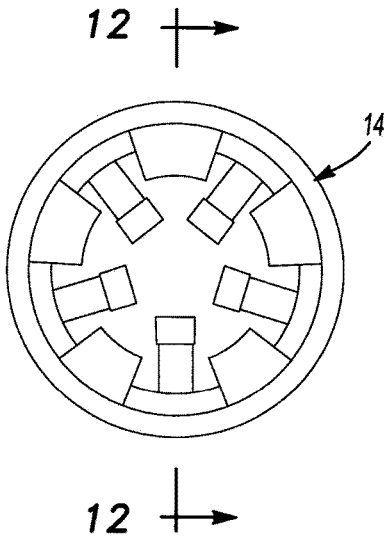
FIG. 11 is a bottom view of the outer closure member according to the principles of the present teachings.

With continued reference to FIGS. 1-7, inner closure 12 can further comprise a series of keys or engagement features 44 radially disposed about a shoulder region 46 thereof. Shoulder region 46, in some embodiments, is formed along a junction of distal end 26 of body portion 20 and proximal end 34 of cap portion 22. Shoulder region 46 can define a surface that is generally orthogonal to a longitudinal axis A-A (FIGS. 3-4). In some embodiments, engagement features 44 comprise radially-disposed, alternating, raised features 47 and lowered features 49 extending about axis A-A along shoulder region 46. It should be understood that alternative shapes of engagement features 44 are anticipated, including rectangular, triangular, serrated, and the like. As will be described, engagement features 44 are sized and shaped to complementarily engage corresponding features formed on outer closure 14 to permit the selective joining of outer closure 14 and inner closure 12 for rotation therewith. In some embodiments, engagement features 44 comprise a plurality of, such as five, raised drivers each having a generally flat top surface 50 (orthogonal to axis A-A) and a generally flat drive surface 52 (parallel to axis A-A) interspersed with lowered or recessed sections (see FIG. 1). In some embodiments, drivers can have a chamfered edge 53 (see FIG. 3) and/or radius edge 55 (see FIG. 1) (or other edge feature) to control and/or modify the associated opening and closing force.

Turning now to FIGS. 8-13, outer closure 14 generally comprises a sidewall 56 having an open proximal end 58 and terminating at an enclosed distal end surface 60. In some embodiments, proximal end 58 is generally flat and abuts or otherwise engages proximal end 24 of inner closure 12. To this end, outer closure 14 can comprise an enlarged retaining ring or flange 62 (FIGS. 1 and 12) circumferentially extending about an inner surface 64 of sidewall 56 adjacent proximal end 58. Retaining ring 62 can be integrally formed with outer closure 14 such that, when outer closure 14 is installed on inner closure 12, retaining ring 62 under hooks proximal end 24 of inner closure 12. In this way, retaining ring 62 captures proximal end 24 of inner closure 12 and retains outer closure 14 in an engaged positioned with inner closure 12, yet permits free relative rotation therebetween when outer closure 14 is in the operationally disengaged position relative to inner closure 12. In some embodiments, retaining ring 62 can define a generally inwardly-directed sloped surface having generally symmetrical ramped surfaces on opposing, longitudinal side. However, it should be understood that retaining ring 62 can comprise alternative cross-sectional shapes, such as a hook shape or other shape that permits easy assembly of outer closure 14 to inner closure 12, but generally prevents removal of outer closure 14 from inner closure 12, yet still provides free rotational movement therebetween.

As described herein, sidewall 56 of outer closure 14, and particularly inner surface 64 of sidewall 56, is generally shaped to closely conform to sidewall 28 of inner closure 12, yet permit free rotational movement therebetween. Accordingly, in some embodiments, inner surface 64 of sidewall 56, at least those portions adjacent sidewall 28 of inner closure 12, are generally free of obstructions. In other embodiments, sidewall 28 of inner closure 12 may have obstructions to permit securing closure on to container finish.

In some embodiments, outer closure 14 can comprise a generally cylindrical shape extending from proximal end 58 to distal end surface 60. In some embodiments, outer closure 14, specifically sidewall 56, can comprise a generally uniform interior surface 64 offset from sidewall 56. In some embodiments, sidewall 56 and/or interior surface 64 can define a draft angle to permit improved manufacturing.

It should be understood that outer closure 14 can be varied in any one of a number of ways. By way of non-limiting example, it should be understood that outer closure 14 can be sized or shaped to more appropriately complement a varied dispensing tip shape or improve user manipulation. Such variations should not be regarded as departing from the principles of the present teachings.

With continued reference to FIGS. 8-13, outer closure 14 can further comprise a series of keys or engagement features 66 radially disposed and inwardly extending toward axis A-A along sidewall 56. More particularly, engagement features 66, in some embodiments, extend inwardly a sufficient distance from sidewall 56 and extend downwardly a sufficient distance from distal end surface 60 to selectively engage engagement features 44 of inner closure when in the operationally engaged position. In this way, engagement features 66 comprise radially-disposed, alternating, inwardly-directed raised features 68 terminating at a head 70 extending about axis A-A. In some embodiments, engagement features 66 are sized and shaped to complementarily engage engagement features 44 of lower closure 12. In this way, head 70 of engagement feature 66 of outer closure 14 engages and is otherwise captured at lowered feature 49 of inner closure 12 between opposing raised features 47. Side surfaces 69, of engagement features 66 (see FIG. 13), contacts drive surfaces 52 of inner closure 12. In this way, engagement feature 66 of outer closure 14 is keyed or otherwise joined with engagement feature 44 of inner closure 12 such that rotational or torsional force applied to outer closure 14 is translated to inner closure 12 for actuation of inner closure 12. Similarly, head 70 of outer closure 14 contacts shoulder region 46 of inner closure 12, to prevent further compressing translation of outer closure 14 relative to inner closure 12 in an axial direction. As will be described, this axial-translation, physical-stop feature is useful in minimizing excessive actuation of spring system 16.

In some embodiments, as illustrated in FIGS. 8-13, engagement feature 66 of outer closure 14 can be configured such that the inwardly-directed features 68 defines a consistent material wall thickness relative to the remaining portions of outer closure 14, thereby resulting in consistent and uniform material qualities and molding results. Moreover, this configuration further results in major recesses 72 being formed in sidewall 56 and viewable from an exterior portion of the outer closure 14. These major recesses 72 are radially disposed about outer closure 14 in alignment with engagement features 66. Major recesses 72 provide improved gripping surface for a user. In some embodiments, major recesses 72 can include extended minor recesses 74. Minor recesses 74 can extend from major recesses 72 toward proximal end 58 for enhanced gripping surface.

Figure 14:
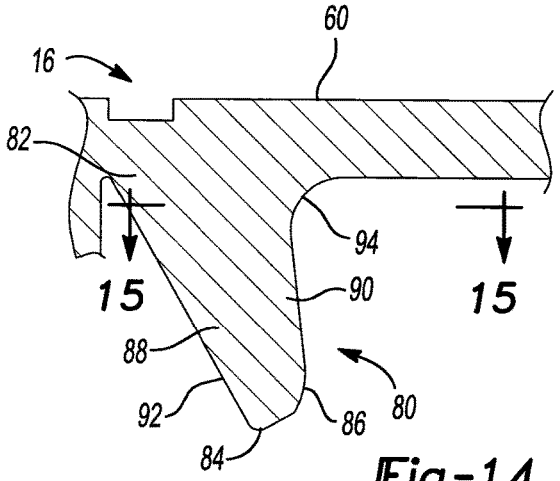
FIG. 14 is a partial cross-sectional view of the finger spring of FIG. 12 according to the principles of the present teachings.
Figure 15:
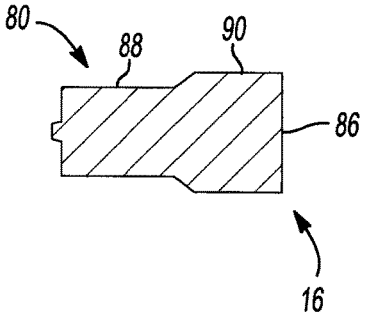
FIG. 15 is a partial cross-sectional view of the finger spring taken along line 15-15 of FIG. 14 according to the principles of the present teachings.
Figure 16:
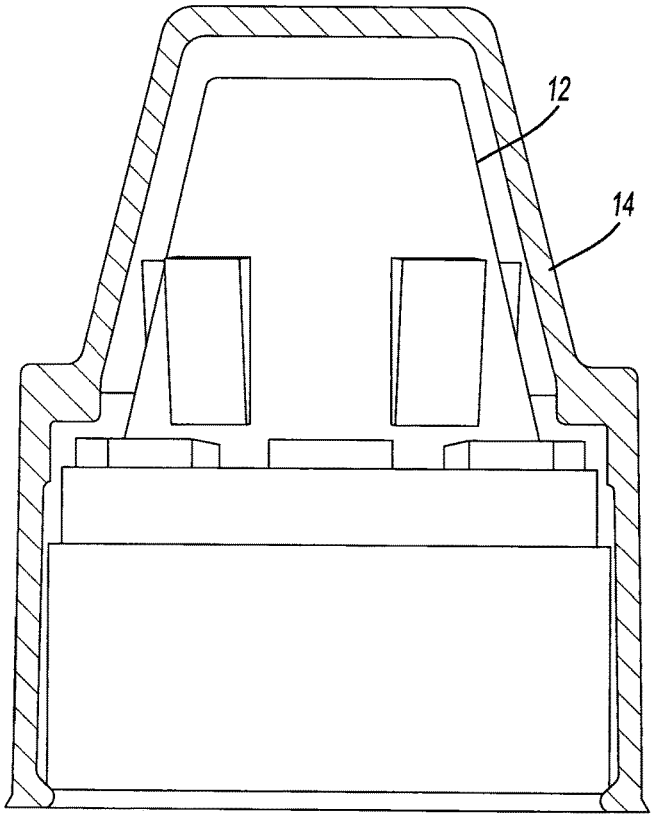
FIG. 16 is a cross-sectional view of a child resistant tip closure assembly according to some embodiments of the present teachings.

With particular reference to FIGS. 1, 14, and 15, spring system 16 will now be discussed in detail. In some embodiments, spring system 16 provides a biasing member operably coupled between inner closure 12 and outer closure 14 to bias outer closure 14 into the aforementioned operational disengagement position. In some embodiments, spring system 16 can comprise a finger spring member 80 extending from distal end surface 60 of outer closure 14. Finger spring member 80 is inwardly directed such that contact and deflection of finger spring member 80 against sloped sidewall 32 of inner closure member 12 causes finger spring member 80 to move outwardly or outboardly away from axis A-A providing biasing resistance.

More particularly, in some embodiments, finger spring member 80 comprises an elongated finger member extending within an inner volume of outer closure 14. Finger spring member 80 can comprise a generally elongated finger having integrally formed with outer closure 14 and extending from distal end surface 60 thereof. In some embodiments, finger spring member 80 comprises a generally-enlarged based portion 82 extending gradually to a generally-narrowed tip portion 84. Finger spring member 80 can be shaped (see FIG. 1) such that it extends angularly toward sloped sidewall 32 of cap portion 22 of inner closure 12 and contacts sidewall 32 along a contact line 86. That is, as finger spring member 80 deflects relative to inner closure 12, the location of the point of contact between finger spring member 80 and inner closure 12 will migrate along finger spring member 80 thereby forming contact line 86. In this way, contact line 86 still remains the sole contact surface between finger spring member 80 and sidewall 32 of inner closure 12. It has been found that by maintaining a single contact point, even if along a line, spring response is more predictable and advantageous.

In operation, finger spring member 80 is configured to deflect outwardly away from axis A-A upon application of translational force of outer closure 14 toward inner closure 12. That is, as outer closure 14 is forwarded downward along axis A-A toward engagement with inner closure 12, finger spring member 80 contacts and glides along sloped sidewall 32 of inner closure 12 thereby applying a radially-directed deflection force against finger spring member 80. This deflection force causes finger spring member 80 to elastically deflect outwardly, thereby resulting in an opposing, tailored flexural response urging outer closure 14 in an upward, axial direction.

Figure 12:
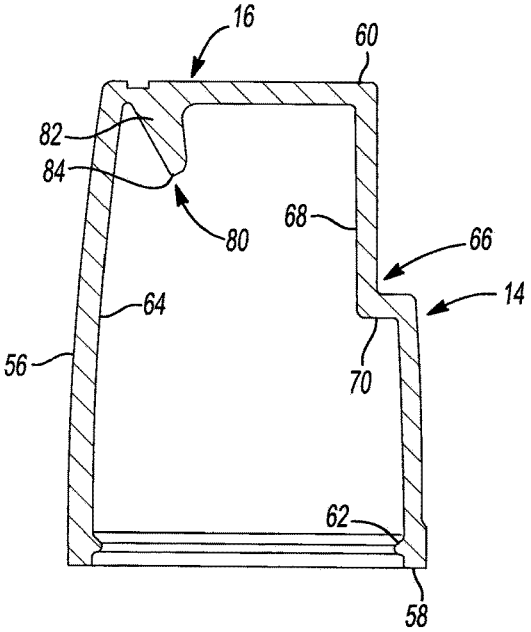
FIG. 12 is a cross-sectional view of the outer closure member taken along line 12-12 of FIG. 11 according to the principles of the present teachings.
Figure 13:
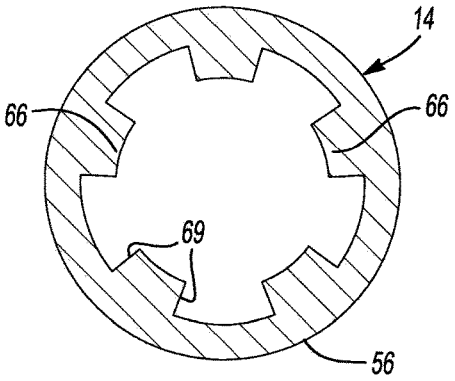
FIG. 13 is a cross-sectional top view of the outer closure member taken along line 13-13 of FIG. 9 according to the principles of the present teachings.

To achieve this tailored flexural response, finger spring member 80 generally defines a triangular side view orientation (see FIGS. 1, 12, and 14). This triangular side view orientation helps to reinforce and stabilize finger spring member 80 against the radially-directed deflection forces. However, due to manufacturing and spring response considerations, it has been found that in some embodiments as illustrated in FIG. 15, finger spring member 80 can comprise a reduced backside rib portion 88 extending along a front side contact face 90. Specifically, in some embodiments, rib portion 88 can define a cross-sectional width that is less than a cross-sectional width of front side contact face 90, thereby resulting in a T-shaped cross-section (see FIG. 15). Front side contact face 90 is generally wider to provide a uniform and consistent contact point 86. The reduced width of rib portion 88 does not substantially affect the structural integrity of finger spring member 80 due to the principle of T-beam design criteria and results in increased resistance to displacement due to bending moment for a given cross-sectional area. The reduced width of rib portion 88 provides the benefit of reducing the material thickness in the region of distal end surface 60, thereby reducing the chance of visual material sink marks resulting from material cooling rate variations during injection molding. A large radius 94 is disposed between distal end surface 60 and front side contact face 90 to minimize stress concentration and plastic deformation (i.e. engineering plastic deformation (e.g. irreversible deformation)) in the area.

The aforementioned configuration generally prevents or at least inhibits high stress and strain at the base of finger spring member 80 to minimize permanent deformation and also provides for flexibility of the tip to allow for proper spring action. The included angle for the shape of finger spring member 84 is between 15 and 40 degrees measured between rear edge 92 of rib portion 88 and axis A-A.

The design spring system 16, and specifically finger spring member 80, is provided such that necessary deflection of outer closure 14 relative to inner closure 12 does not result in plastic deformation of spring system 16. In other words, the length and thickness of rib portion 88 and front side contact face 90 is determined such that the necessary stroke of outer closure 14 relative to inner closure 12 to achieve engagement of engagement features 66 of outer closure 14 with engagement features 44 of inner closure 12 does not result in plastic deformation of finger spring member 80.

A physical axial translation limitation prevents finger spring member 80 from deflecting to such a distance that would result in plastic deformation. This physical axial translation limitation can include the aforementioned physical stop between head 70 of outer closure and shoulder region 46. It should be noted that a distance between truncated surface 38 of inner closure 12 and an inner surface of distal end surface 60 of outer closure 14 is greater than the stroke distance to prevent inadvertent contact of outer closure 14 and inner closure 12 at said location.

In some embodiments, inner closure 12 and outer closure 14 can be made of dissimilar materials to minimize friction between the two members, once assembled. In some embodiments, inner closure 12 can be made of polypropylene and outer closure 14 can be made of high density polyethylene or polypropylene copolymer.

With reference to FIGS. 16-19, it should be appreciated that alternative designs exist. For example, in connection with FIG. 16, in some embodiments, an alternative engagement system can be employed wherein engagement features are deployed along cap portion 22 of inner closure 12 and outer closure 22. Moreover, in some embodiments, alternatives are envisioned for spring system 16. With particular reference to FIG. 17, in some embodiments, spring system 16 can comprise upturned spring fingers that are deflectable against an inner surface of outer closure. Similarly, as illustrated in FIG. 18, in some embodiments, opposing spring fingers, deployed on inner closure 12 and outer closure 14 can be mutually actuated during translation of outer closure relative to inner closure. Still further, in some embodiments as illustrated in FIG. 19, outer closure 14 can comprise an inwardly directed curved members molded into and extending from outer closure and deflectable against inner closure to provide a biasing response.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A child resistant closure for use on a container, said container having a threaded finish, said child resistant closure comprising:

an inner closure member having a threaded portion and an inclined surface, said threaded portion being configured to threadedly engage the threaded finish;

a plurality of first engagement features extending from said inner closure member;

an outer closure member having a sidewall and a distal end surface, said outer closure member being operably coupled to said inner closure member to permit limited axial translation along an axis between said outer closure member and said inner closure member;

a plurality of second engagement features extending from said outer closure member, the plurality of second engagement features including heads of a recess formed on an exterior surface of said outer closure member, said outer closure member being positionable in an operationally engaged position wherein said plurality of second engagement features engage said plurality of first engagement features to fix said outer closure member into rotation with said inner closure member, said outer closure member being positionable in an operationally disengaged position wherein said plurality of second engagement features are disengaged from said plurality of first engagement features to permit free rotational movement around said axis of said outer closure relative to said inner closure, movement between said operationally engaged position and said operationally disengaged position being along said axis;

and at least one finger spring member being disposed along said distal end surface of said outer closure spaced apart from the first engagement features and the second engagement features, said at least one finger spring member is inwardly directed and contacting said inclined surface of said inner closure member thereby biasing said outer closure member into said operationally disengaged position;

wherein said inner closure member comprises:

a base portion having said threaded portion;

a cap portion extending from said base portion, said cap portion having said inclined surface engageable with said at least one finger spring member; and a shoulder region disposed between said base portion and said cap portion, said shoulder region having said plurality of first engagement features.

2. The child resistant closure according to claim 1 wherein said at least one finger spring member comprises a contact face portion engaging said inner closure member along a first side and a rib portion extend along an opposing second side of said contact face portion, a width of said rib portion being less than a width of said contact face portion thereby forming a T-shaped cross-section.

3. The child resistant closure according to claim 2 wherein said contact face portion and said rib portion of said at least one finger spring member form a rectangular cross-section.

4. The child resistant closure according to claim 2 wherein said at least one finger spring member comprises:

an enlarged base portion adjacent distal end surface of said outer closure member; and a narrowed tip portion distal of said enlarged base portion, wherein said rib portion extends a first distance from said contact face portion at said narrowed tip portion and extends a second distance from said contact face portion at said enlarged base portion, said second distance being greater than said first distance.

5. The child resistant closure according to claim 4 wherein said contact face portion contacts said inner closure member at a contact point, said contact point translating along a contact line during movement from said operationally disengaged position to said operationally engaged position.

6. The child resistant closure according to claim 1 wherein said at least one finger spring member designed to minimize irreversible deformation in said operationally engaged position.

7. The child resistant closure according to claim 1 wherein a stroke distance between said operationally disengaged position and said operationally engaged position is less than a distance resulting in irreversible deformation of said at least one finger spring member.

8. The child resistant closure according to claim 1 wherein engagement of said plurality of first engagement features with said plurality of second engagement features results in a physical stop preventing further axial translation of said outer closure member relative to said inner closure member.

9. The child resistant closure according to claim 1, further comprising:

a retaining ring extending along said outer closure member, said retaining ring engaging a proximal end of said inner closure member retaining said outer closure member and said inner closure member in said operably coupled position.

10. The child resistant closure according to claim 1 wherein said inclined surface of said inner closure is inclined at an angle in a range of approximately 8° to approximately 16° from a longitudinal axis of said closure.

11. The child resistant closure according to claim 10 wherein said angle is approximately 12°.

12. The child resistant closure according to claim 1 wherein a contact angle between said at least one finger spring member and said inner closure member is in a range of approximately 20° to approximately 40°.

13. The child resistant closure according to claim 12 wherein said contact angle is approximately 30°.

14. The child resistant closure according to claim 1 wherein a ratio of an inner radius of said at least one finger spring member and a length of said at least one finger spring member is in a range of approximately 1:2 to approximately 1:6.

15. The child resistant closure according to claim 14 wherein said ratio is approximately 1:3.85.

* * * * *